United States Patent [19]

Mazziotta

[11] Patent Number: 5,048,759

[45] Date of Patent: Sep. 17, 1991

[54] HAND-HELD SHOWER DEVICE

[75] Inventor: Phillip R. Mazziotta, Ramsey, N.J.

[73] Assignee: Lee Matthew Enterprises, Inc., Hackensack, N.J.

[21] Appl. No.: 478,692

[22] Filed: Feb. 12, 1990

[51] Int. Cl.[5] ..... B05B 1/30

[52] U.S. Cl. ..... 239/529; 239/579; 239/542

[58] Field of Search ..... 239/579, 576, 569, 529, 239/530; 251/331, 353, 354, 7

[56] References Cited

U.S. PATENT DOCUMENTS

| | | | |
|---|---|---|---|
| 307,871 | 11/1884 | Richtmann | 251/7 |
| 1,533,732 | 4/1925 | Frost | 539/529 |
| 1,861,442 | 6/1932 | Hammerstein | 251/353 X |
| 1,958,430 | 5/1934 | Hartog | 251/353 X |
| 2,656,219 | 11/1953 | Torbet | 239/524 X |
| 2,681,752 | 6/1957 | Jarrett et al. | 251/33 X |
| 2,797,837 | 7/1957 | Roberts | 251/7 X |
| 3,426,949 | 2/1969 | James | 251/353 X |
| 4,081,176 | 3/1978 | Johnson | 251/353 X |
| 4,489,914 | 12/1984 | Stevenson et al. | 239/579 X |
| 4,735,010 | 4/1988 | Grinarml | 239/36 X |

*Primary Examiner*—Andres Kashnikow
*Assistant Examiner*—Kevin P. Weldon
*Attorney, Agent, or Firm*—Klauber & Jackson

[57] ABSTRACT

A hand-held shower device includes a base; an elastic strap connected with the base for securing the hand-held shower device to a hand of a person; a deformable dome secured to the base in covering and liquid sealing relation thereto so as to define a chamber therebetween, the dome having a plurality of spray openings therein; an L-shaped conduit for supplying a liquid to the chamber, the conduit having an open end extending into the chamber; a switchable valve positioned in the chamber for opening and closing the open end of the conduit in a toggle manner upon repeated depression of the dome; and a temperature sensitive switch for shutting off the flow of the liquid to the conduit when the temperature of the liquid exceeds a predetermined temperature.

12 Claims, 4 Drawing Sheets

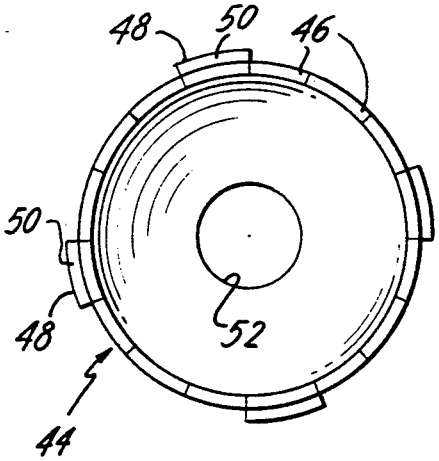
FIG. 7
FIG. 9
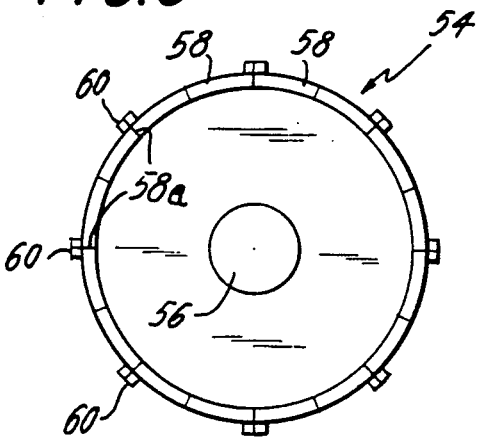
FIG. 10
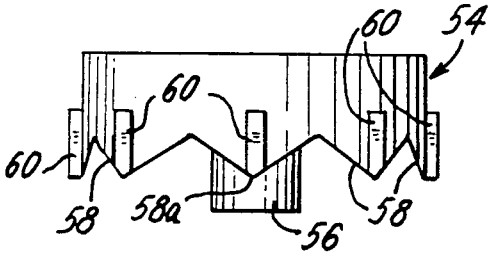
FIG. 8
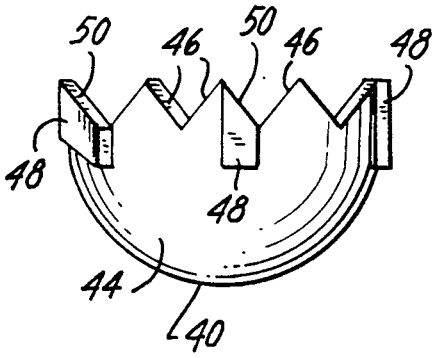
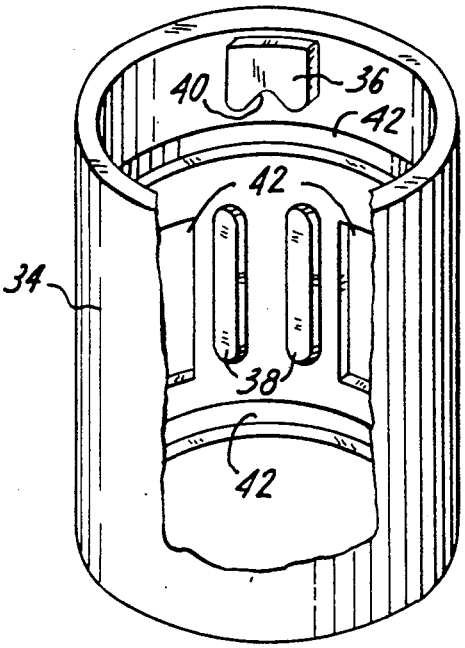
FIG. 6

HAND-HELD SHOWER DEVICE

BACKGROUND OF THE INVENTION

This invention relates generally to shower devices, and more particularly, is directed to a hand-held shower device for use with infants.

Washing of new-born infants is often performed in a sink or a special tub adjacent a sink. The infant is generally bathed with a wash cloth and rinsed off in the same manner. However, a mother bathing her infant must constantly reach for the faucet to rinse off the wash cloth of soap and dirt. This becomes difficult since the mother is also usually holding the infant. In addition, with an infant in the sink, the faucet must be constantly turned on and off during such rinsing. As a result, the temperature must be readjusted each time, and there is the possibility that the infant can even be scalded.

It would be desirable to be able to rinse the soap from the infant with a shower device. The problem with conventional shower devices is that the spray cannot be easily controlled, particularly with the mother holding the infant. In addition, temperature changes in the spray are difficult to control, and the infant may become fearful of the device.

A spraying glove is disclosed in Cray U.S. Pat. No. 836,181 in which the glove has a reinforcing piece secured to the palm of the glove. A coupling is secured to a tube which supplies water to the chamber formed by the reinforcing piece. A plurality of openings are formed in the reinforcing piece for discharging the water to the bather. However, a separate stop-cock type valve is provided in the tube which supplies water to the chamber, so that the water cannot easily be turned on and off. In addition, there is no manner of controlling the water flow if the temperature exceeds a certain temperature.

Roe U.S. Pat. No. 1,651,550 discloses a hand-held shower device for supplying water to a sponge or other article held in the same hand of the user. Water is supplied through an L-shaped inlet nozzle, to an outlet thereof provided with a plurality of spray holes. A ball-valve seats against an annular washer disposed within the coupling sleeve that is attached to the inlet of the nozzle, under the pressure of incoming water. A valve stem is secured at one end to the ball-valve and at its opposite end extends out from the nozzle so as to be secured to a curved finger portion. When the curved finger portion is depressed, the ball-valve is unseated so as to permit the flow of water through the nozzle. On the other hand, when the curved finger portion is released, the water pressure will seat the ball-valve against the annular washer to shut off the supply of water. However, such device becomes impractical when bathing an infant. This is because the mother is holding the infant with one or both hands, and must also be concerned about bathing the infant, that is, directing the spray to the infant. By requiring that the curved finger portion also be held down, there is more complication, and therefore, greater risk of an accident to the infant.

Shower devices are also known which include an actuator for shutting off the flow of water when the temperature exceeds a certain temperature, as disclosed, for example, in Allison U.S. Pat. No. 3,938,741; McGinnis U.S. Pat. No. 4,281,790; and Tacchi U.S. Pat. No. 4,463,899.

The entire disclosures of all of the aforementioned U.S. Patents are incorporated herein by reference.

OBJECTS AND SUMMARY OF THE INVENTION

Accordingly, it is an object of the present invention to provide a hand-held shower device that avoids the aforementioned problems with the prior art.

It is another object of the present invention to provide a hand-held shower device that is removably securable to the hand of a person.

It is still another object of the present invention to provide a hand-held shower device that can be easily turned on and off with the same hand during use.

It is yet another object of the present invention to provide a hand-held shower device that can be toggled between its on and off conditions.

It is a further object of the present invention to provide a hand-held shower device in which the water supply thereto will be shut off when the temperature of the water exceeds a predetermined temperature.

It is a still further object of the present invention to provide a hand-held shower device that is relatively easy and economical to use and manufacture.

It is a yet further object of the present invention to provide a hand-held shower device which permits a mother to hold an infant with both hands while also bathing the infant, thereby giving greater control to the mother, permitting the mother to give more affection to the infant, and eliminating the infant's fear of water or soap.

In accordance with an aspect of the present invention, a hand-held shower device includes a base; strap means connected with the base for securing the hand-held shower device to a hand of a person; a deformable dome secured to the base in covering and liquid sealing relation thereto so as to define a chamber therebetween, the dome having a plurality of spray openings therein; conduit means for supplying a liquid to the chamber, the conduit means having an open end extending into the chamber; and switchable valve means positioned in the chamber for opening and closing the open end of the conduit in a toggle manner upon repeated depression of the dome.

In accordance with another aspect of the present invention, a hand-held shower device includes a base; strap means connected with the base for securing the hand-held shower device to a hand of a person; a deformable dome secured to the base in covering and liquid sealing relation thereto so as to define a chamber therebetween, the dome having a plurality of spray openings therein; conduit means for supplying a liquid to the chamber, the conduit means having an open end extending into the chamber; switchable valve means positioned in the chamber for opening and closing the open end of the conduit in a toggle manner upon repeated depression of the dome; and temperature sensitive switch means for shutting off the flow of the liquid to the conduit means when the temperature of the liquid exceeds a predetermined temperature.

The above and other objects, features and advantages of the present invention will become readily apparent from the following detailed description which is to be read in connection with the accompanying drawings.

BRIEF DESCRIPTION OF THE DRAWINGS

FIG. 6 is an enlarged, partially broken away view of the guide casing of the ON/OFF valve of the hand-held shower device of FIG. 5;

FIG. 7 is a top plan view of the lower seal section of the ON/OFF valve of the hand-held shower device of FIG. 5;

FIG. 8 is a side plan view of the lower seal section of FIG. 7;

FIG. 9 is a bottom plan view of the upper locking section of the ON/OFF valve of the hand-held shower device of FIG. 5;

FIG. 10 is a side plan view of the upper locking section of FIG. 9;

DETAILED DESCRIPTION OF THE PREFERRED EMBODIMENTS

Figure 1:
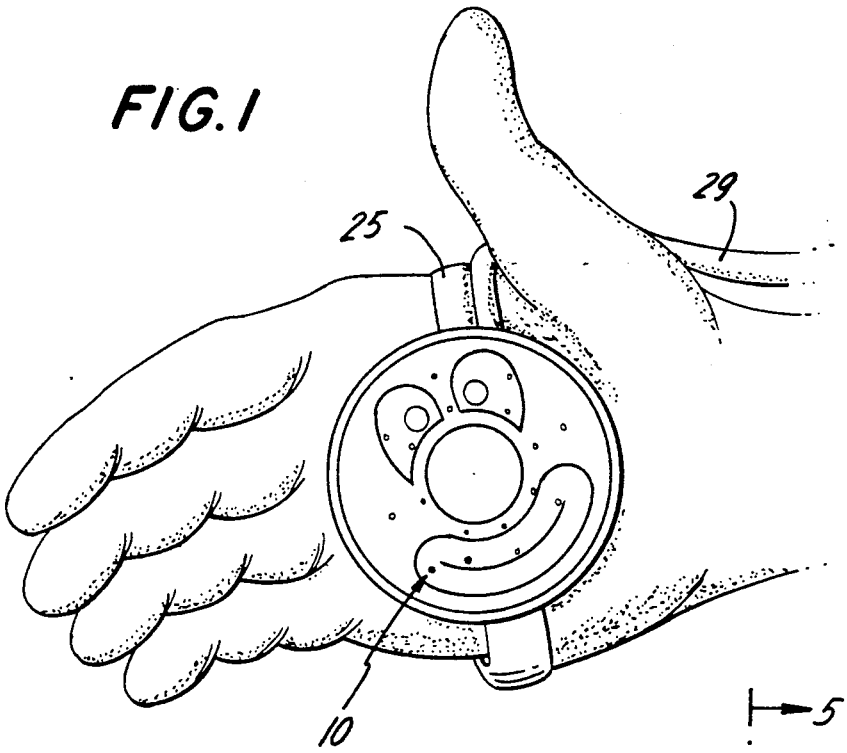
FIG. 1 is a perspective view of a hand-held shower device according to one embodiment of the present invention, in use.
Figure 2:
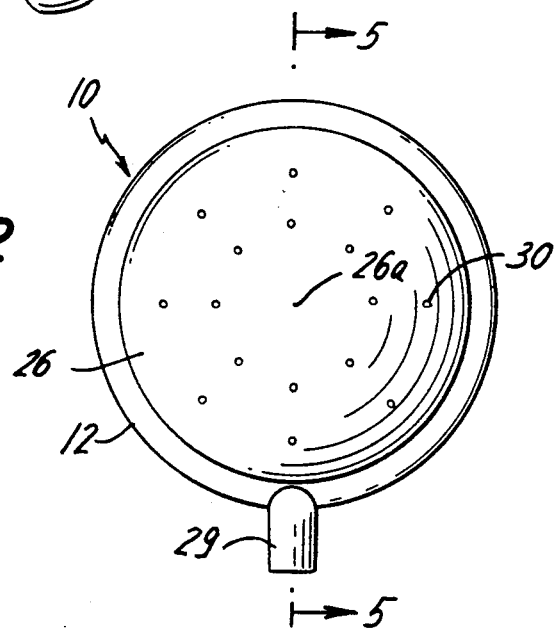
FIG. 2 is a top plan view of the hand-held shower device of FIG. 1.
Figure 3:
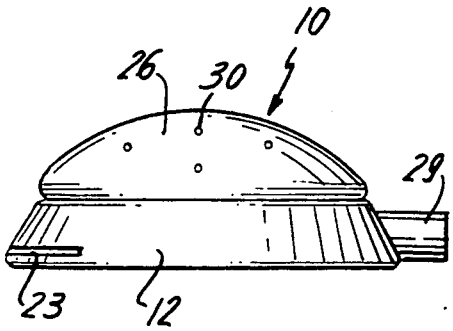
FIG. 3 is a side plan view of the hand-held shower device of FIG. 1.
Figure 4:
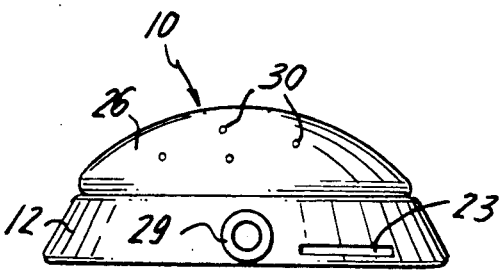
FIG. 4 is a side plan view of the hand-held shower device of FIG. 1, rotated by 90 degrees from FIG. 3.
Figure 5:
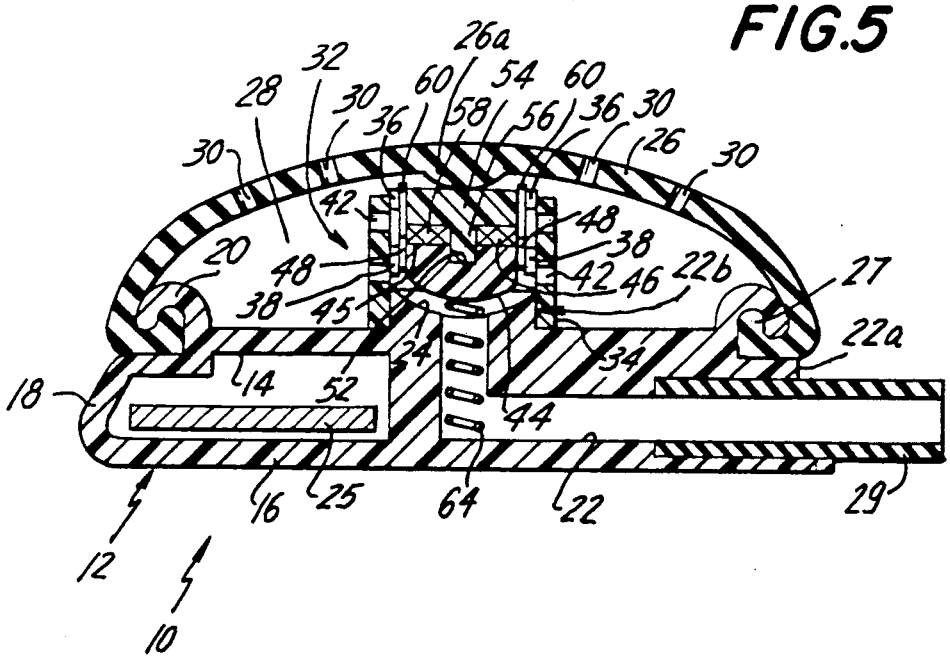
FIG. 5 is a cross-sectional view of the hand-held shower device of FIG. 2, taken along line 5—5 thereof, in its open position.

Referring to the drawings in detail, and initially to FIGS. 1–11 thereof, a hand-held shower device 10 according to a first embodiment of the present invention, includes a circular base 12 having an upper circular wall 14 and a lower circular supporting wall 16 spaced from upper wall 14 and parallel thereto. Upper and lower walls 14 and 16 are connected together by a circumferential side wall 18. In addition, as will be made clear from the description which follows, the outer periphery of upper wall 16 has a circumferential hook section 20 formed on the upper surface thereof. An L-shaped conduit 22 is also formed in base 12, terminating at one end **22*a* through side wall 18, and at its opposite end 22*b* extending up through the center of upper wall 16. As shown in FIG. 5, end 22*b* of conduit 22 extends to a height above the upper surface of upper wall 14, and has a beveled opening 24 thereat. Finally, two opposite slits 23 are formed in side wall 18 of base 12 so as to permit entry of an endless elastic strap 25 therethrough. As a result, strap 25 will hold shower device 10 on the hand of the mother during use. Strap 25 could also be open and securable by a "VELCRO" arrangement around the wrist of the user. It will be appreciated that base 12** is preferably of a one-piece molded construction.

A dome section 26 of a rubber or slightly deformable plastic material is secured on the upper surface of upper wall 14 of base 12. In this regard, dome section 26 is provided with an inturned circumferential bead 27 at its lower end which is engaged by hook section 20 so as to secure dome section 26 to base 12 and so as to provide a liquid seal thereat. In addition, a rubber gasket seal (not shown) can be provided thereat. Accordingly, a sealed liquid chamber 28 is formed between the upper surface of upper wall 14 of base 12 and the lower surface of dome section 26. Water is supplied to chamber 28 through conduit 22. To this end, a flexible hose 29 extends through conduit 22 at side wall 18 with a friction fit, so as to supply water from a water supply, such as a sink or the like, to chamber 28. Dome section 26 is also provided with a plurality of radially arranged spray holes 30 therein. Thus, when water under pressure is supplied to chamber 28 through conduit 22, the water will escape as a plurality of jet sprays through spray holes 30. In addition, dome section 26 preferably has a decoration thereon, such as the clown face shown in FIG. 1, so as not to scare an infant.

In accordance with one aspect of the present invention, an ON/OFF valve 32 is provided which can be toggled between the on and off positions. ON/OFF valve 32 operates in a similar manner to a conventional clicking mechanism or insertion and extraction device for a pen point of a ball-point pen. Thus, when the center **26*a* of dome section 26 is depressed, valve 32 functions to either close or open beveled opening 24 of conduit 22, and to remain in such position until center 26*a* of dome section 26** is once again depressed, and so on.

As shown in FIGS. 5 and 6, valve 32 includes a cylindrical guide casing 34 which sits on upper wall 14 about end **22*b* of conduit 22 and within chamber 28, and extends to a height just below dome section 26. As shown, casing 34 includes a pair of diametrically opposite upper guides 36 and two pair of diametrically opposite lower guides 38. Upper guide 36, as in a conventional insertion and extraction device for a ball-point pen, includes a shallow recess 40 at its lower end. In addition, a plurality of openings 42 are provided about casing 34**.

Figure 11:
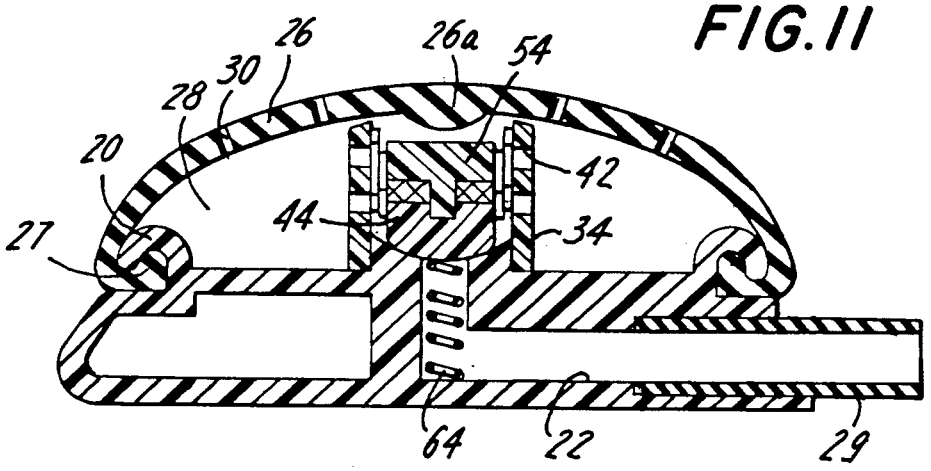
FIG. 11 is a cross-sectional view of the hand-held shower device of FIG. 5, in its closed position.

A cylindrical lower seal section 44, as best shown in FIGS. 5, 7 and 8, having a lower face 45 which matches the configuration of the beveled opening 24 of conduit 22, is positioned within casing 34. Thus, as shown in FIG. 11, lower face 45 can seal conduit 22 so as to prevent the flow of water therethrough. Lower seal section 44 has eight circumferentially arranged teeth 46 which extend upwardly, and four equiangularly and circumferentially arranged ramp elements 48 connected to the outer portion of the teeth. As is well known for insertion and extraction devices for a pen point of a ball-point pen, each element 48 is ramped at its upper end in correspondence with one-half of a tooth 46 and is connected to its respective tooth in alignment therewith. The upper ramp surfaces 50 of all elements 48 are inclined in the same angular direction. In addition, a central bore 52 is provided in the upper face of lower seal section 44. With this arrangement, ramp elements 48 are restrained by lower guides 38 so as to permit axial movement of lower seal section 44, while preventing rotatable movement thereof.

A cylindrical upper locking section 54 is provided above lower seal section 44, and includes a central lower post 56 which rotatably fits within central bore 52 of lower seal section 44. Upper locking section 54 also includes eight circumferentially arranged teeth 58 at the lower end which extend downwardly for engagement with teeth 46 of lower seal section 44. A biasing element 60 is connected to the outer portion of each tooth 58, and converges to a point 62 at the peak 58*a* of the respective tooth 58. With this arrangement, biasing elements 60 are restrained by upper guides 36 so as to permit axial movement of upper locking section 54, while permitting rotation of upper locking section 54 only when upper locking section 54 has been moved downwardly such that biasing elements 60 are no longer restrained by upper guides 36.

Further, a coil spring 64 is positioned in conduit 22 and extends outwardly therefrom to normally bias lower seal section 44 upwardly, out of sealing contact with beveled opening 24 of conduit 22.

In operation, initially in the open, operating condition, the lower seal section 44 and upper locking section 54 are arranged as shown in FIG. 5. In this condition, guides 36 and 38 restrict rotation of both sections 44 and 54, such that the peaks of teeth 46 and 58 are in contact. Guides 36 and 38 also align lower seal section 44 and upper locking section 54 so that points 62 of four of the biasing elements 60 are in contact with the upper edge of ramp surfaces 50 of elements 48. This contact is maintained by spring 64.

When center 26*a* of dome section 26 is depressed, upper locking section 54 is moved downwardly. Because of the contact between sections 44 and 54, lower seal section is also moved downwardly into tight sealing contact with beveled opening 24 of conduit 22, against the force of spring 64. Continued depression will deform lower seal section 44 slightly since lower seal section 44 is preferably made from a deformable plastic material, or has a rubber undercoating or the like. As a result, biasing elements 60 are no longer restrained by upper guides 36. Because of the contact of points 62 with ramp surfaces 50, upper locking section 54 thereby rotates until two biasing elements 60 are positioned in shallow recesses 40 of upper guides 36. Accordingly, locking section 54 is moved to a lower position, as shown in FIG. 11. In this position, locking section 54 locks lower seal section 44 in a sealing position on conduit 22. Further, during this position, upper locking section 54 has rotated such that other points 62 of elements 60 are in contact with the upper ends of ramp surfaces 50 of elements 48, due to the alignment caused by guides 36 and 38. Accordingly, the peaks of teeth 46 and 58 are again in contact. It will be appreciated that there may be some trickle or water when biasing elements 60 are in shallow recesses 40, since there may be some play between lower sealing section 44 and beveled opening 24. However, such trickle is minimal, and also relieves the valve pressure somewhat to prevent breakage of the valve assembly.

If center 26*a* of dome section 26 is once again depressed such that biasing elements 60 are removed from shallow recesses 60, ramps 50 against cause upper locking section 54 to rotate again by the same amount. Accordingly, upper locking section 54 and lower seal section 44 are moved upwardly to the position of FIG. 5 by coil spring 64.

The above operation can be continuously repeated to toggle lower seal section 44 between the sealing position of FIG. 11 and the unsealing or operable position of FIG. 5. As a result, the user is not required to constantly keep a button depressed to render hand-held shower device 10 operable, as in U.S. Pat. No. 1,651,550.

It will be appreciated that various modifications can be made to the above arrangement. For example, although eight teeth have been shown in each section 44 and 54, the number of teeth can vary.

Figure 12:
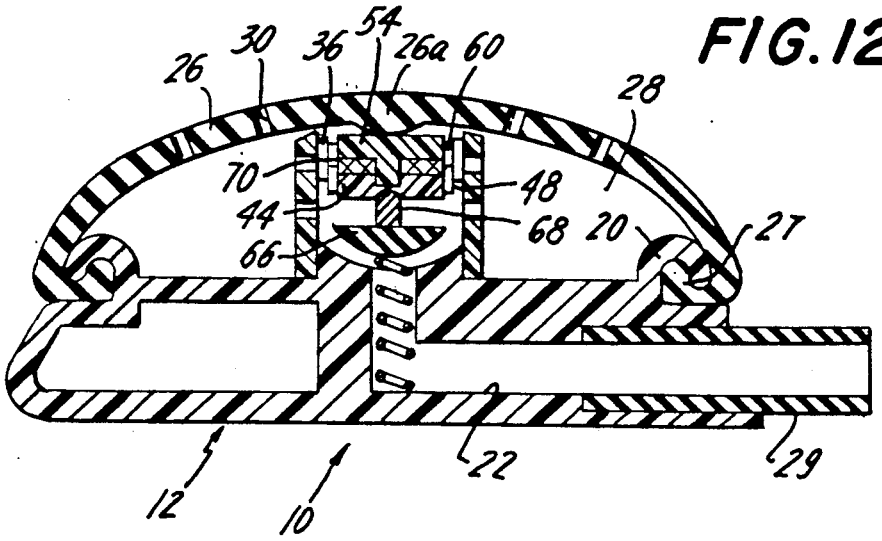
FIG. 12 is a cross-sectional view of a hand-held shower device similar to FIG. 5, showing another ON/-OFF valve that can be used.

Referring now to FIG. 12, there is shown a modification of hand-held shower device 10, in which like elements are represented by like numerals, and a detailed description of such like elements will be omitted herein for the sake of brevity. As shown therein, upper locking section 54 can be made to move only axially, with lower seal section 44 moving axially, and moving rotatably only when it is depressed a sufficient distance. In this case, lower guides 38 would be eliminated and upper guides 36 would be extended downwardly to the position of the lower guides 38. Upper guides 36 would still have shallow recesses 40 which would be necessary for locking lower seal section 44. Further, in such case, it would be ramp sections 48 that are locked by shallow recesses 40. In such case, lower seal section 44 would not be able to rotate when in contact with beveled opening 24. Accordingly, as shown in FIG. 12, a separate seal 66 is provided in sealing contact with beveled opening 24 and is rotatably connected with lower seal section 44 through a shaft 68 rotatably received in a central lower bore 70 of lower seal section 44.

Figure 13:
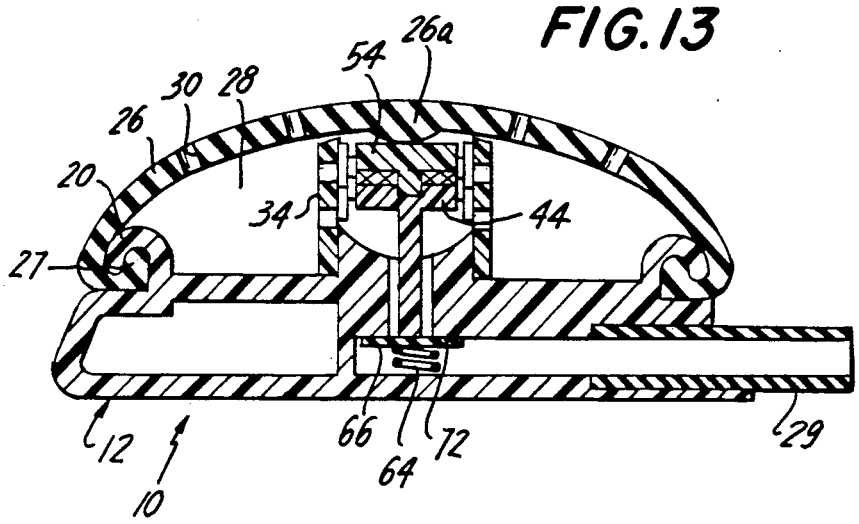
FIG. 13 is a cross-sectional view of a hand-held shower device similar to FIG. 5, showing another ON/-OFF valve that can be used.

Referring now to FIG. 13, there is shown another modification of hand-held shower device 10, in which like elements are represented by like numerals, and a detailed description of such like elements will be omitted herein for the sake of brevity. As shown therein, separate seal 66 can be provided within conduit 22, so as to seat against a lower surface 72 thereof at the juncture of the L-shape thereof. This arrangement would operate in a similar manner to that of FIG. 12, but is preferable thereto. This is because, in the closed position, the water pressure aids in seating seal 66 to close conduit 22, whereas in the embodiments of FIGS. 5–12, the water pressure works against the seal in the closed condition.

In accordance with another aspect of the present invention, water to hand-held shower device 10 is shut off when the temperature of the water exceeds a predetermined temperature. This can be accomplished by any conventional device, such as the "FLOW GARD" Model V-110 A "MEMRYSAFE" actuator, sold by Memory Plumbing Supplies, Inc. of 83 Keeler Street, Norwalk, Conn. This device is disclosed in U.S. Pat. No. 4,778,104, the entire disclosure of which is incorporated herein by reference. Thus, when the water reaches a potentially scalding temperature, the actuator will reduce the flow to a safe trickle. Preferably, in accordance with the present invention, water flow will stop when the temperature exceeds a temperature in the range of 110–120 degrees. Other devices that can be used are described in the aforementioned U.S. Pat. Nos. 3,938,741; 4,281,790; and 4,463,899. Preferably, such device is inserted between flexible hose 29 and a faucet.

Figure 14:
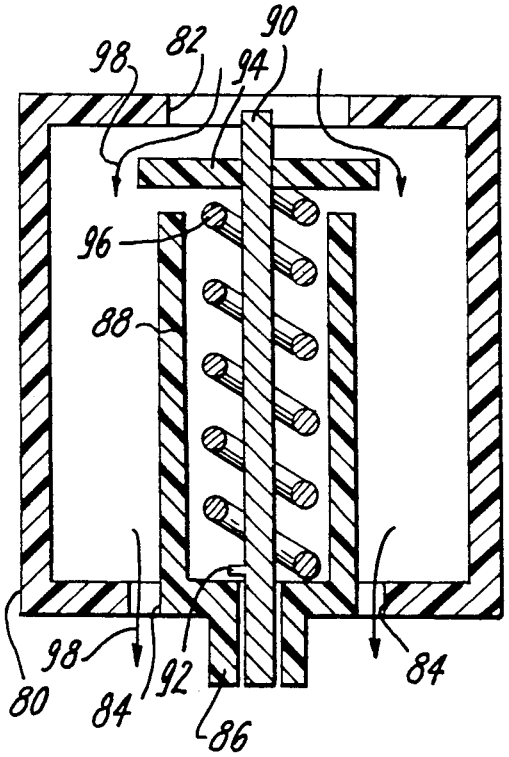
FIG. 14 is a cross-sectional view of a temperature control valve for use with the hand-held shower device of FIG. 1, in a condition permitting flow of water therethrough.
Figure 15:
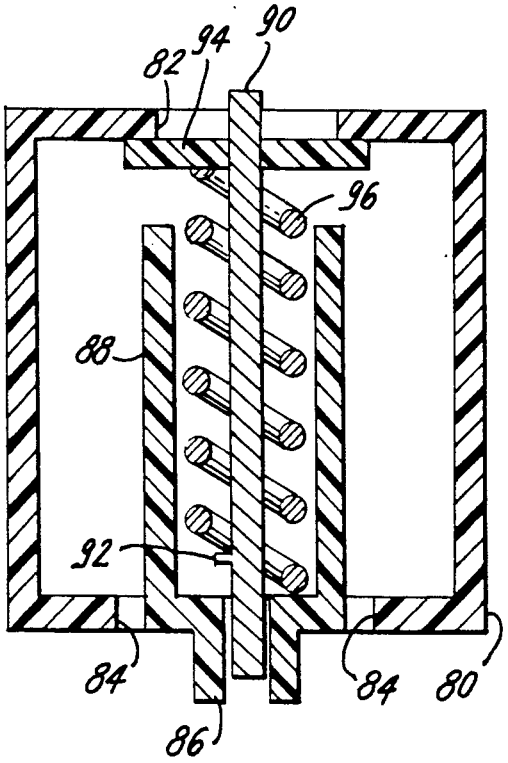
FIG. 15 is a cross-sectional view of the temperature control valve of FIG. 14, in a condition preventing flow of water therethrough.

An example of a device that can be used will now be described with respect to FIGS. 14 and 15. As shown therein, a cylindrical main housing 80 includes a central upper opening 82 and lower openings 84 arranged about a circle. Main housing 80 further includes a central lower guide sleeve 86, and an inner cylindrical wall 88 within the circle defined by openings 84 and extending to a height less than that of housing 80. Accordingly, water can flow through upper opening 82 and out from lower openings 84, and then, through flexible hose 29 and conduit 22 to chamber 28.

A shaft 90 extends within inner cylindrical wall 88 and is reciprocally guided at its lower end within guide sleeve 86. Shaft 90 has a protuberance 92 at the lower end thereof to limit downward movement thereof. A sealing plate 94 is secured to the upper end of shaft 90, and a temperature responsive coil spring 96 is positioned about shaft 90 and within inner cylindrical wall 88. The lower end of coil spring 96 sits on the lower wall of main housing 80, and the upper end of coil spring 96 supports sealing plate 94 thereon. Coil spring 96 can be made of any suitable material, such as titanium, so as to expand when water in contact therewith exceeds a predetermined temperature.

In the normal operating condition shown in FIG. 14, coil spring 96 supports sealing plate 94 in a position spaced below upper opening 82. Accordingly, water can flow through main housing in the direction of arrows 98. If the temperature of the water exceeds the predetermined temperature, coil spring 96 will expand to the position shown in FIG. 15, so as to bias sealing plate 94 upwardly in sealing relation to opening 82, thereby preventing the flow of the hot water therethrough. This prevents scalding of the infant.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A hand-held shower device comprising:

a base;

strap means connected with said base for securing said hand-held shower device to a hand of a person;

a deformable dome secured to said base in covering and liquid sealing relation thereto so as to define a chamber therebetween, said dome having a plurality of spray openings therein;

conduit means for supplying a liquid to said chamber, said conduit means having an open end extending into said chamber; and switchable valve means positioned in said chamber for:

i) opening said open end of said conduit upon exertion of a depressing force on said dome and for maintaining said open end of said conduit in open fluid communication with said chamber upon release of said depressing force on said dome, and ii) subsequently closing said open end of said conduit upon exertion of a subsequent depressing force on said dome and for maintaining said open end of said conduit in closed fluid communication with said chamber upon release of said subsequent depressing force on said dome.

2. A hand-held shower device according to claim 1, wherein said dome is made of a rubber material.

3. A hand-held shower device according to claim 1, wherein said dome is made of a slightly deformable plastic material.

4. A hand-held shower device according to claim 1, wherein said conduit means extends through said base.

5. A hand-held shower device according to claim 4, wherein said base has an upper wall, a lower wall spaced from the upper wall and a connecting side wall, and said conduit means extends through said side wall, between said upper and lower walls, and then extends through said upper wall into said chamber.

6. A hand-held shower device according to claim 5, wherein said side wall has two slits therein, and said strap means extends through said slits and between said upper and lower walls of said base.

7. A hand-held shower device comprising:

a base;

strap means connected with said base for securing said hand-held shower device to a hand of a person;

a deformable dome secured to said base in covering and liquid sealing relation thereto so as to define a chamber therebetween, said dome having a plurality of spray openings therein;

conduit means for supplying a liquid to said chamber, said conduit means having an open end extending into said chamber;

switchable valve means positioned in said chamber for:

i) opening said open end of said conduit upon exertion of a depressing force on said dome and for maintaining said open end of said conduit in open fluid communication with said chamber upon release of said depressing force on said dome, and ii) subsequently closing said open end of said conduit upon exertion of a subsequent depressing force on said dome and for maintaining said open end of said conduit in closed fluid communication with said chamber upon release of said subsequent depressing force on said dome; and temperature sensitive switch means for shutting off the flow of said liquid to said conduit means when the temperature of said liquid exceeds a predetermined temperature.

8. A hand-held shower device according to claim 7, wherein said dome is made of a rubber material.

9. A hand-held shower device according to claim 7, wherein said dome is made of a slightly deformable plastic material.

10. A hand-held shower device according to claim 7, wherein said conduit means extends through said base.

11. A hand-held shower device according to claim 10, wherein said base has an upper wall, a lower wall spaced from the upper wall and a connecting side wall, and said conduit means extends through said side wall, between said upper and lower walls, and then extends through said upper wall into said chamber.

12. A hand-held shower device according to claim 11, wherein said side wall has two slits therein, and said strap means extends through said slits and between said upper and lower walls of said base.

* * * * *